US006409127B1

(12) United States Patent
VanderHeide et al.

(10) Patent No.: US 6,409,127 B1
(45) Date of Patent: Jun. 25, 2002

(54) ADJUSTABLE KEYBOARD SUPPORT MECHANISM

(75) Inventors: Craig L. VanderHeide, Comstock Park; John P. Conner, Grandville, both of MI (US)

(73) Assignee: Knape & Vogt Manufacturing Co., Grand Rapids, MI (US)

( * ) Notice: Subject to any disclaimer, the term of this patent is extended or adjusted under 35 U.S.C. 154(b) by 0 days.

(21) Appl. No.: 09/398,414

(22) Filed: Sep. 17, 1999

Related U.S. Application Data

(60) Provisional application No. 60/105,886, filed on Oct. 27, 1998.

(51) Int. Cl.[7] ..... A47B 57/00

(52) U.S. Cl. ..... 248/118; 108/93; 248/118.3; 248/284.1; 248/291.1; 248/918

(58) Field of Search ..... 248/286.1, 284, 248/286, 918, 118, 118.1, 118.3, 276.1, 291.1; 108/93, 145

(56) References Cited

U.S. PATENT DOCUMENTS

| | | | | |
|---|---|---|---|---|
| 4,616,798 A | | 10/1986 | Smeenge et al. | |
| D306,239 S | | 2/1990 | Watt | |
| 4,981,085 A | | 1/1991 | Watt | |
| 5,037,054 A | | 8/1991 | McConnell | |
| 5,145,136 A | | 9/1992 | McConnell | |
| 5,180,136 A | | 1/1993 | Sova | |
| 5,181,620 A | | 1/1993 | Watt | |
| 5,211,367 A | * | 5/1993 | Musculus | |
| 5,230,289 A | | 7/1993 | George et al. | |
| D339,703 S | | 9/1993 | Pangborn et al. | |
| 5,257,767 A | | 11/1993 | McConnell | |
| 5,294,087 A | | 3/1994 | Drabczyk et al. | |
| 5,351,897 A | | 10/1994 | Martin | |
| 5,403,097 A | | 4/1995 | Woof | |
| 5,443,237 A | * | 8/1995 | Stadtmauer | 248/918 |
| 5,501,420 A | | 3/1996 | Watt et al. | |
| 5,653,413 A | * | 8/1997 | Fink | 248/918 |
| 5,823,487 A | * | 10/1998 | Kirchoff et al. | 248/118 |
| 5,836,560 A | | 11/1998 | Kaplan et al. | |

* cited by examiner

*Primary Examiner*—Ramon O. Ramirez
*Assistant Examiner*—Tan Le
(74) *Attorney, Agent, or Firm*—McGarry Bair LLP

(57) ABSTRACT

An adjustable keyboard support assembly including a keyboard tray support bracket; a work surface mounting bracket adapted to be coupled to a work surface; a connector mechanism having one end coupled to the work surface mounting bracket and an opposite end coupled to the keyboard tray support bracket, the connector mechanism comprising a support arm coupled to the keyboard support at an outer end, such that the keyboard tray support bracket is rotatable about a horizontal axis with respect to the support arm; an angle control mechanism between the keyboard tray support bracket and the support arm for locking the keyboard tray support bracket at a desired angular inclination with respect to the support arm, the angle control mechanism including a spring exerting a clamping pressure on the support arm and the keyboard tray support bracket and a spring lifter for repositioning the spring so as to relieve the pressured applied to the support arm and the keyboard tray support bracket; and a lever control bar coupled to the keyboard tray support bracket and the spring lifter for actuating the spring lifter to permit adjustment of the keyboard tray support bracket with respect to support arm. The lever control bar is pivotally mounted to the keyboard tray support bracket, and is substantially co-extensive with a front edge of the keyboard tray such that the keyboard support assembly may be repositioned using one hand.

63 Claims, 11 Drawing Sheets

Fig. 13
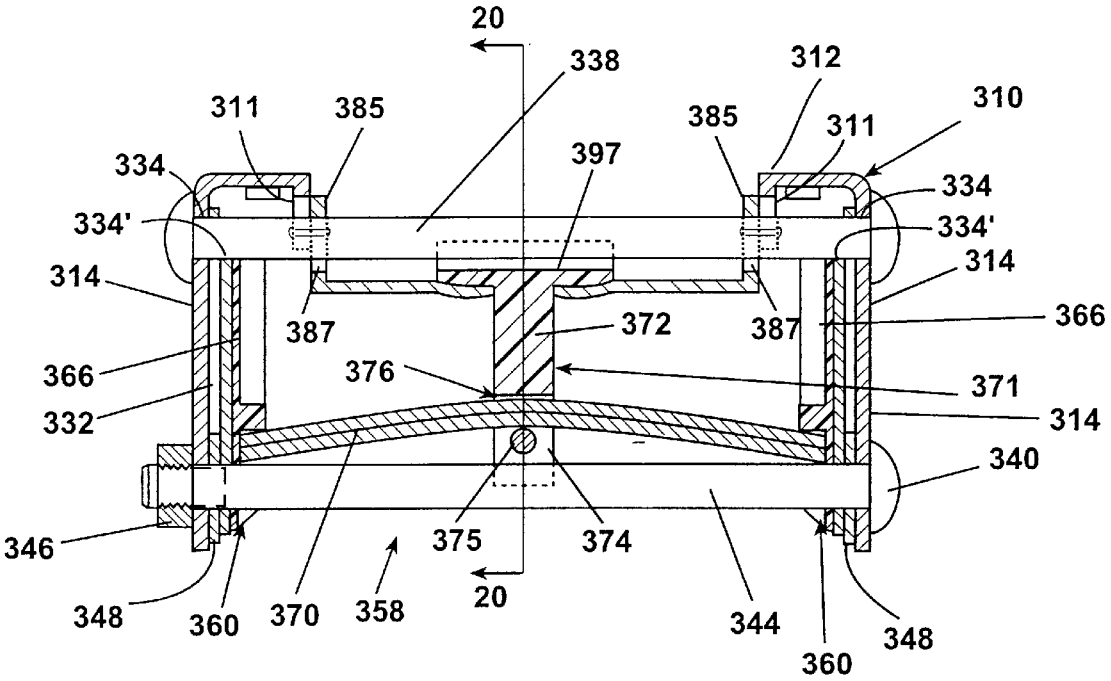
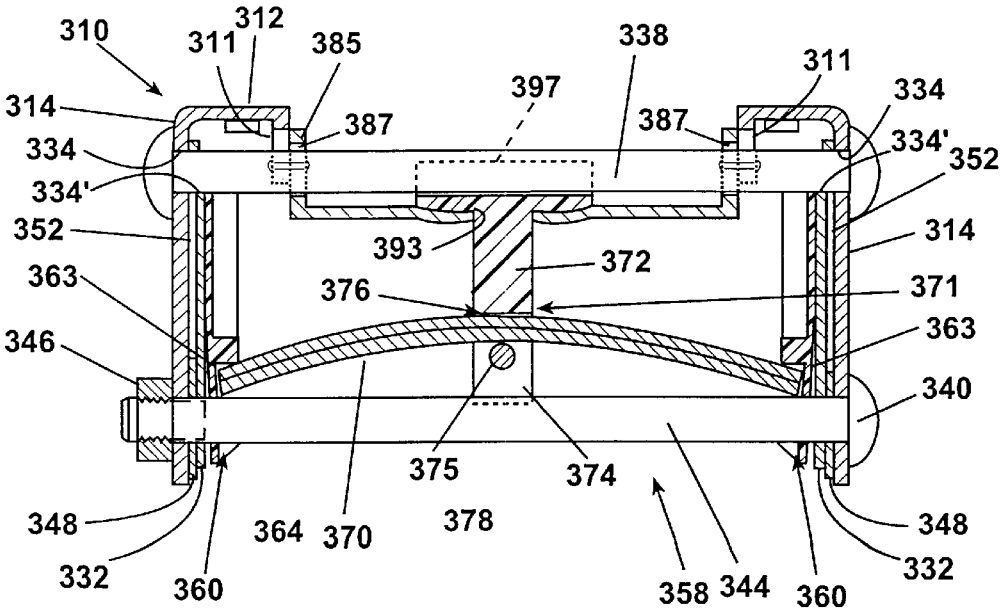
Fig. 14

ADJUSTABLE KEYBOARD SUPPORT MECHANISM

CROSS REFERENCE TO RELATED APPLICATIONS

This application claims the benefit of U. S. Provisional Application No. 60/105,886, filed Oct. 27, 1998.

FIELD OF THE INVENTION

This invention relates to adjustable keyboard support mechanisms. In one of its aspects, the invention relates to an adjustable keyboard support mechanism for selective adjustment of an angular orientation and/or height of a keyboard tray by manipulating a single control lever. In another of its aspects, the invention relates to an adjustable keyboard support mechanism for single-handed selective adjustment of the height and/or angular position of a keyboard tray.

BACKGROUND OF THE INVENTION

A number of keyboard support mechanisms have been developed for supporting a computer keyboard on the underside of a work surface. One such device is shown in FIGS. 1–9 to which reference is now made.

An adjustable keyboard support mechanism 10 including a keyboard support 15 coupled by a connector mechanism 18 to a work surface mounting mechanism 20 that is removably coupled to the underside 24 of a work surface 14. The keyboard support 15 provides the supporting surface for a keyboard, and includes a keyboard tray support bracket 16. The keyboard tray support bracket 16 includes a flat plate 26. Preferably plate 26 is a stamped metal component, and includes a plurality of openings 27. Plate 26 also includes vertical flanges 28, which extend downwardly at opposite side edges of the plate 26. Flanges 28 include aligned openings 126 formed in an upper portion near the rear of flanges 28 and aligned arcuate slots 130 positioned below openings 126.

Keyboard tray 31 includes two slidable plates 40 and 41. Plate 40 is a substantially rectangular member, and includes a front edge 33 that supports at least one upwardly extending tab 32 and a downwardly extending tab 38. The front edge 33 also supports an outwardly extending arm 37. Plate 40 also includes a top surface 39 that defines a pair of axially extending slots 49 and an axially extending slot 44 positioned between slots 49. Additionally, side edges 46 of plate 40 support a downwardly extending, inwardly facing C-shaped flange 48.

Plate 41 includes a top surface 39' that defines a plurality of openings 46. The rear edge 35 of plate 41 supports flange 34, wherein flange 34 defines a central opening 169.

To assemble plates 40, 41, plate 41 is slidably received in C-shaped flange 48. The plates 40, 41 are fastened together by a bolt clamp mechanism 43 that fits into slot 44 and screws 47 that are received in openings 47'. An adjustment knob 45 screws onto bolt 42 received in slot 44 to clamp or release plates 40, 41 for adjustment. The positions of the plates 40, 41 may be adjusted to fit different keyboards.

Turning now to a discussion of work surface mounting mechanism 20, work surface mounting mechanism 20 couples keyboard support 15 to work surface 14. A carriage 60 is slidably mounted in a track 50 mounted on the underside of work surface 14 by means of fasteners 52, as illustrated in FIG. 5. Track 50 has a central plate 54 that abuts the underside of work surface 14, with inwardly facing C-shaped flanges 56 on each side of central plate 54. Flanges 56 define opposed slots 58 that receive and hold carriage 60 for inward and outward slidable movement with respect to work surface 14.

Carriage 60 includes a work surface mounting bracket 61 having a central horizontal plate 62 having downwardly extending flanges 64 on opposite lateral sides thereof. Flanges 64 include aligned openings 113 located at an upper forward end and aligned openings 159 also formed in the forward end, but at a position below openings 113.

A slide mechanism 66 is carried by plate 62. Slide mechanism 66 comprises a central plate 68 that abuts plate 62 and raised side flanges 70 that are spaced above plate 62 and extend outwardly from plate 68. Side flanges 70 fit in slots 58 of track 50 and guide the rear support for linear movement in a forward and backward direction with respect to work surface 14.

Slide mechanism 66 is mounted in track 50 by a plurality of slidable bearing members 80, shown in detail in FIGS. 6 and 7. Bearings 80 contact surface of track 50 and provide the surface upon which slide mechanism 66 contacts track 50.

Bearings 80 comprise elongated strips of tough flexible plastic material, preferably having a low coefficient of friction. The strips form upper and lower bearing surfaces in the form of V-shaped ridges 88 spaced laterally apart on the upper and lower surface thereof, as illustrated in FIG. 7. Ridges 88 provide a reduced contact bearing surface for engagement with upper and lower surfaces of adjacent slots 58. Bearings 80 are positioned at the four corners of slide mechanism 66 and do not extend the length of flanges 70.

The strips of bearing material 80 fit through slots 82 at the front and rear edges of each slide member 66. The strips have mating latch members 84 and 86 on the ends at an inner side thereof to permit the strips to be installed and replaced on slide member 66. Latch members 84, 86 form a clip mechanism 87 that can be mechanically engaged. Clip mechanism 87 has a lip on a lower edge that extends outwardly which engages a lip that extends inwardly from an upper edge. When installed, clip mechanism 87 does not become easily disengaged and generally requires that latch members 84, 86 be broken for removal. This prevents bearing 80 from inadvertently coming off during use. One advantage of bearing members 80 is that they provide a minimal surface contact area for maximum slip and are easily replaced when worn out.

Slide mechanism 66 is mounted on plate 62 of work surface mounting bracket 61 by a central pivot bolt 90. Pivot bolt 90 permits pivotal movement of keyboard support 15 and bracket 62 about a vertical axis defined by the axis of bolt 90. The manner in which these members are connected together permits rotation of keyboard support 15 in a smooth manner that provides just enough resistance to rotation to maintain keyboard 12 in the position to which it is moved.

As shown in FIGS. 8 and 9, pivot bolt 90 is a socket head bolt. Pivot bolt 90 fits through an opening 92 in plate 68, and in opening 63 in plate 62. The head of pivot bolt 90 is spaced from plate 68 by a low friction Nylon washer 94 or similar material. The underside of plate 68 engages a circular Nylon plate 96, which in turn bears against upper plate 62 of work surface mounting bracket 61. An annular rib 98 extends downwardly from plate 68 (or it could alternatively be formed in disk 96) so as to minimize the surface contact between slider plate 68 and disk 96. Another nylon washer 100 is positioned between disk 96 and slider plate 68. A steel washer 102 is positioned on the outside of plate 62, and a nut 104 is threaded on the end of pivot bolt 90. Nut 104 is carefully tightened with a torque wrench until there is just enough rotation resistance to maintain keyboard 12 in a desired rotational position. Once pivot bolt 90 is sufficiently tightened, the end of pivot bolt 90 is flared with a center punch to provide an enlarged portion 106 that locks nut 104 in its desired position. Nut 104 can be a lock nut having a nylon insert or the like in order to provide additional resistance to undesired rotation of nut 104.

If inward and outward sliding of keyboard tray 31 is not required, slider mechanism 66 and track 50 can be eliminated, and work surface mounting bracket 61 may be attached directly to the underside of work surface 14.

Turning now to a discussion of connector mechanism 18, connector mechanism 18 interconnects work surface mounting mechanism 20 and keyboard support 15. Connector mechanism 18 includes a support arm 110, as best shown in FIGS. 2 and 9, which is pivotally coupled at an inner end 108 to work surface mounting bracket 61. At opposite end 109, support arm 110 is pivotally coupled to tray support bracket 16. This coupling arrangement allows support arm 110 to rotate about a horizontal axis that runs transverse to support arm 110, thus permitting support arm 1 10 to be pivoted upwardly and downwardly to raise and lower the height of keyboard tray support bracket 16.

Support arm 110 includes a flat central plate 112 having an opening 164 located adjacent a front edge 107. Opening 164 acts as a passthrough for guiding keyboard cable 166 and/or mouse cable 168 to a position at the rear of the keyboard support 15.

Support arm 110 also includes vertical flanges 114 that extend downwardly from the outer side edges 111 of central plate 112. It will be appreciated that central plate 112 and flanges 114 may be integrally formed or constructed as separate components. Flanges 114 define aligned openings 115 at a rear edge 121 thereof. At a front edge 123, flanges 114 extend outwardly beyond the end of central plate 112 to form a mounting flange 117 for attaching support arm 110 to keyboard tray support bracket 16.

Mounting flanges 117 are triangularly shaped members having upper ends 118 that form aligned openings 120 therein, and wider lower ends 152 defining arcuate slots 124, with the center of arc of slot 124 being the axis of the respective opening 120.

To assemble connector mechanism 18 to work surface mounting mechanism is 20, flanges 114 fit closely between flanges 64 of work surface mounting bracket 61. Flanges 114, 64 are bolted or riveted together using pivot pin 116, which extends through openings 113 and 115 in flanges 64 and 114, respectively. Caps 119 snap onto the ends of pivot pin 116 to hold pivot pin 116 in position. A torsion spring 127 mounted on pin 116 biases support arm 110 upwardly. The bottom portions of flanges 64 are coupled to lock arms 150 by a pivot pin 158 inserted through aligned openings 159 of flanges 64 and 152 of lock arms 150, respectively.

To assemble connector mechanism 18 to tray support bracket 15, flanges 114 and 28 are coupled together. To prevent flanges 117 and 28 from wearing against one another, a friction reducing gasket 145 is positioned between flanges 28 and flanges 117. Gasket 145 has an opening 147 in an upper portion that aligns with opening 120 of flanges 117 and a square opening 148 in a lower portion that aligns with slots 124, 130 of flanges 117, 28, respectively. The square opening 148 retains a square head 134' on bolt 134. Another round hole 149 in a bottom portion of the gasket 145 is aligned with the square opening 148 and receives the shaft of bolt 134.

In coupling flanges 117 and 28 together, pivot pin 122 extends through openings 146 and continues through aligned openings 120, 126 of flanges 117, 28, respectively. Pivot pin 122 pivotally mounts keyboard tray support bracket 16 to support arm 110, and is held in place by end caps 132, which snap onto the ends of pivot pin 122.

At the opposite end, arcuate slots 124 of flanges 117 align with arcuate slots 130 in side flanges 28, with arcuate slots 130 being shorter than arcuate slots 124. A tube 136 is positioned between arcuate slots 124, 130, and bolt 134 extends through arcuate slots 124, 130, tube 136 and washers 138 and through gaskets 145 and holes 154 of lock arms. Bolt 134 continues through a second tube 140 and washers 142 located on the opposite side of keyboard tray support bracket 16 where the threaded end 146 of bolt 134 engages keyboard adjustment knob 144.

Adjustment knob 144 threads onto threaded end 146 of bolt 134 so that rotation of knob 144 in one direction tightens bolt 134 and clamps flanges 28 and 117 together and gaskets 145 and lock arm holes 154 so as to prevent rotation. When knob 144 is released, keyboard tray support bracket 16 is free to pivot about the axis of pivot pin 122, openings 120, 126 of flanges 117 and 28, respectively. This construction makes it possible to have adjustment knob 144 on either one or both sides of keyboard tray support bracket 16.

The foregoing construction provides the connection between work surface mounting bracket 61 and keyboard tray support bracket 16, and also provides for inclination adjustment of keyboard tray support bracket 16 with respect to connector mechanism 18. In order to secure connector mechanism 18 at any given rotational position for a desired keyboard height elevation, a pair of locking arms 150 extend between work surface mounting bracket 61 and keyboard tray support bracket 16 at a position below and in contact with a lower edge 152 of flanges 114. Locking arms 150 are elongated elliptically shaped members having ends 156 and 162. End 156 includes an opening 152, and opposite end 162 includes an opening 154.

Ends 156 are brought into contact with the sides of side flanges 114 of support arm 110. Ends 156 are also pivotally mounted to flanges 64 of work surface mounting bracket 61 by means of pivot pin 158 that extends through openings 159 in flanges 64, which are aligned with openings 152 in arms 150. Caps 160 are mounted onto the ends of pivot pin 158 to hold pivot pin 158 in place.

Opposite ends 162 of locking arms 150 receive bolt 134 therethrough. Ends 162 traverse freely along slots 124 and 130 until locked in place at a desired location in slots 124, 130 by tightening keyboard tray support bracket adjustment knob 144. When locking arms 150 are locked, arms 150 serve the purpose of locking support arm 110 at a desired rotational position.

When locking arms 150 are assembled with support arm 110, work surface mounting bracket 61 and keyboard tray support bracket 16, it is necessary that locking arms 150 slide past side brackets 114 of support arm 110. To permit this to happen, a washer 172 (FIG. 6) is positioned between flanges 114 and 64. This permits locking arms 150 to pivot upwardly adjacent flanges 114 on the inner side thereof as the keyboard is raised and lowered.

In operation, keyboard tray support bracket 16 and keyboard 12 can be raised and lowered by releasing adjustment knob 144 (which releases locking arms 150) and thereafter raising or lowering keyboard tray support bracket 16 to its desired elevation. For instance, when the elevation of keyboard tray support bracket 16 is selected, keyboard tray support bracket 16 is rotated to the inclination desired and adjustment knob 144 is tightened. Tightening adjustment knob 144 locks the inclination of keyboard tray support bracket 16 and the height of keyboard tray support bracket 16. When keyboard tray support bracket 16 is locked in position, slider mechanism 66 permits keyboard tray support bracket 16 to be pushed inwardly and outwardly with respect to work surface 14. Additionally, keyboard tray support bracket 16 may be pivoted in a horizontal direction about the axis of bolt 90. As will be appreciated, the user must hold the keyboard tray with one hand, rotate the adjustment knob 144 with the other hand to relieve the frictional clamp between flanges 28 and 117, adjust the keyboard support with the one hand and then tighten the adjustment knob 144 with the other hand to set the keyboard in adjusted position.

As illustrated by the foregoing discussion, prior art keyboard support mechanisms typically require tightening or loosening of one or more adjustment control knobs 144 to move keyboard tray 15 to the desired setting. Additionally, these systems generally include complex mechanical systems that include many components that are impacted upon adjustment of the keyboard support mechanism to the desired setting.

SUMMARY OF THE INVENTION

According to the invention, an adjustable keyboard support assembly comprises a keyboard tray support bracket; a work surface mounting bracket adapted to be coupled to a work surface; a connector mechanism having one end coupled to the work surface mounting bracket and an opposite end coupled to the keyboard tray support bracket. The connector mechanism comprises a support arm coupled to the keyboard support bracket at an outer end, such that the keyboard tray support bracket is rotatable about a horizontal axis with respect to the support arm. An angle control mechanism between the keyboard tray support bracket and the support arm locks the keyboard tray support bracket at a desired angular inclination with respect to the support arm. The angle control mechanism includes a spring which exerts a clamping pressure on the support arm and the keyboard tray support bracket and a spring lifter for repositioning the spring so as to relieve the pressure applied to the support arm and the keyboard tray support bracket. A lever control bar is coupled to the keyboard tray support bracket and the spring lifter for actuating the spring lifter for selective adjustment of the keyboard tray support bracket with respect to the support arm.

Preferably, the connector mechanism and the keyboard tray support bracket are pivotally interconnected for rotation about a horizontal pivot axis. In one embodiment, the angle control mechanism further includes a pair of spaced apart clamping plates and the spring is placed in compression between the clamping plates. The spring is preferably at least one leaf spring and preferably two leaf springs. In one embodiment, the at least one leaf spring comprises a fiber filled synthetic resin. Preferably, the fiber filled synthetic resin is a fiberglass filled polyester resin and the at least one spring is pultruded.

In one embodiment, the lever control bar is pivotally mounted to the keyboard tray support bracket and has an outer end that is substantially co-extensive with a front edge of the keyboard tray.

In another embodiment of the invention, the adjustable keyboard support assembly includes a connector mechanism mounted at one end to a work surface mounting bracket and at an opposite end to the keyboard tray support bracket for height adjustment of the keyboard tray support bracket with respect to the work surface support bracket. The connector arm comprises a support arm coupled to the keyboard tray support bracket such that the keyboard tray support bracket is vertically adjustable with respect to the support arm.

Further according to the invention, an adjustable keyboard support assembly comprises a keyboard tray support bracket, a work surface mounting bracket adapted to be coupled to a work surface and a keyboard tray mounted to the keyboard tray support bracket. The keyboard tray has a front edge distal from the work surface mounting bracket. A connector mechanism has one end coupled to the work surface mounting bracket and an opposite end coupled to the keyboard tray support bracket for rotation about a horizontal axis and height articulation of the keyboard tray support bracket with respect to the work surface mounting bracket. A locking mechanism is associated with the connector mechanism for selectively locking the keyboard tray support bracket at a desired articulated position with respect to the work surface mounting bracket. A release mechanism is coupled to the locking mechanism and includes a lever control bar coupled to the locking mechanism for selectively releasing the locking mechanism for selective adjustment of the height and/or angular orientation of the keyboard tray support bracket with respect to the work surface mounting bracket.

The lever control bar has an outer end which is substantially co-extensive with the front edge of the keyboard tray and adjacent thereto for release of the locking mechanism and for vertical and/or height adjustment of the keyboard tray with respect to the work surface mounting bracket with one hand by the user.

In one embodiment, the lever control bar is pivotally mounted to the keyboard tray support bracket. In addition, the locking mechanism includes at least one leaf spring and preferably two leaf springs. Further, the at least one leaf spring comprises a fiber filled synthetic resin, preferably a fiberglass filled polyester resin. In a preferred embodiment of the invention, the at least one leaf spring is pultruded.

Further according to the invention, an adjustable keyboard support assembly comprises a keyboard tray support bracket, a work surface mounting bracket adapted to be coupled to a work surface and a connector mechanism having one end coupled to the work surface mounting bracket and an opposite end coupled to the keyboard tray support bracket. The connector mechanism comprises a support arm mounted at one end to the work surface mounting bracket and a coupling mounting another end of the support arm to the keyboard tray support bracket for rotatable movement of the keyboard tray support bracket about a horizontal axis with respect to the support arm. An angle control mechanism between the keyboard tray support bracket at a desired angular inclination with respect to the support arm. The angle control mechanism includes a spring exerting a clamping pressure on the support arm and the keyboard tray support bracket, a spring lifter for repositioning the spring so as to relieve the pressure applied to the support arm and the keyboard tray support bracket and a lever control bar coupled to the keyboard tray support bracket and spring lifter for selective repositioning of the spring lifter for selective adjustment of the keyboard tray support bracket with respect to support arm. The level control bar is positioned parallel and proximate to an underside of the keyboard tray support bracket.

Further according to the invention, an adjustable keyboard support assembly comprises a keyboard tray support bracket, a work surface mounting bracket adapted to be coupled to a work surface, a keyboard tray mounted to the keyboard tray support bracket and having a front edge distal from the work surface mounting bracket, a connector mechanism having a first end coupled to the work surface mounting bracket and a second end coupled to the keyboard tray support bracket for height adjustment of the keyboard tray support bracket with respect to the work surface mounting bracket, and a locking mechanism associated with the connector mechanism for selectively locking the keyboard tray support bracket at a desired position with respect to the work surface mounting bracket. The locking mechanism includes a release mechanism coupled to the keyboard tray support bracket for selectively releasing the locking mechanism for selective adjustment of the height of the keyboard tray support bracket with respect to the work surface mounting bracket. The release mechanism includes a lever control bar having an outer end which is substantially co-extensive with and underneath the front edge of the keyboard tray, whereby a user can release the locking mechanism and adjust the keyboard tray support bracket with repsect to the work surface mounting bracket with one hand.

In a further embodiment, the connector mechanism is further coupled to the keyboard tray support bracket for adjustment of the keyboard tray support bracket about a horizontal axis with respect to the work surface mounting bracket.

In a further embodiment, the locking mechanism further comprises a leaf spring exerting opposing clamping forces between the connector mechanism and the keyboard tray support bracket.

In a further embodiment, the lever control bar is elongate and substantially parallel to an underside of the keyboard tray support bracket.

Further according to the invention, an articulated support mechanism has a first end coupled to a primary support and a second end coupled to an auxiliary support bracket for selectively positioning the auxiliary support bracket with respect to the primary support. The articulated support mechanism comprises a locking mechanism for selectively locking the auxiliary support bracket at a desired position with respect to the primary support. The locking mechanism includes a release mechanism coupled to the auxiliary support bracket for selectively releasing the locking mechanism. The release mechanism includes a lever control bar having an outer end which is substantially co-extensive with and underneath a front edge of the articulated support, whereby a user can release the locking mechanism and adjust the auxiliary support with respect to the primary support with one hand.

In a further embodiment, the locking mechanism is for selectively locking the auxiliary support bracket at a desired height with respect to the primary support.

In a further embodiment, the locking mechanism is further for selectively locking the auxiliary support bracket at a desired angular attitude with respect to the primary support.

In a further embodiment, the locking mechanism is for selectively locking the auxiliary support bracket at a desired height and angular attitude with respect to the primary support.

BRIEF DESCRIPTION OF THE DRAWINGS

The features and inventive aspects of the present invention will become more apparent upon reading the following detailed description, claims and drawings, of which the following is a brief description:

FIG. 13 is a sectional view taken along lines 13—13 of FIG. 12, showing the height and inclination adjustment mechanism of the invention shown in FIG. 11 in the locked position;

FIG. 14 is a cross-sectional view similar to FIG. 13 of the keyboard support mechanism shown in FIGS. 11–13, showing the height and inclination adjustment mechanism in its released position;

DETAILED DESCRIPTION OF THE INVENTION

Figure 1:
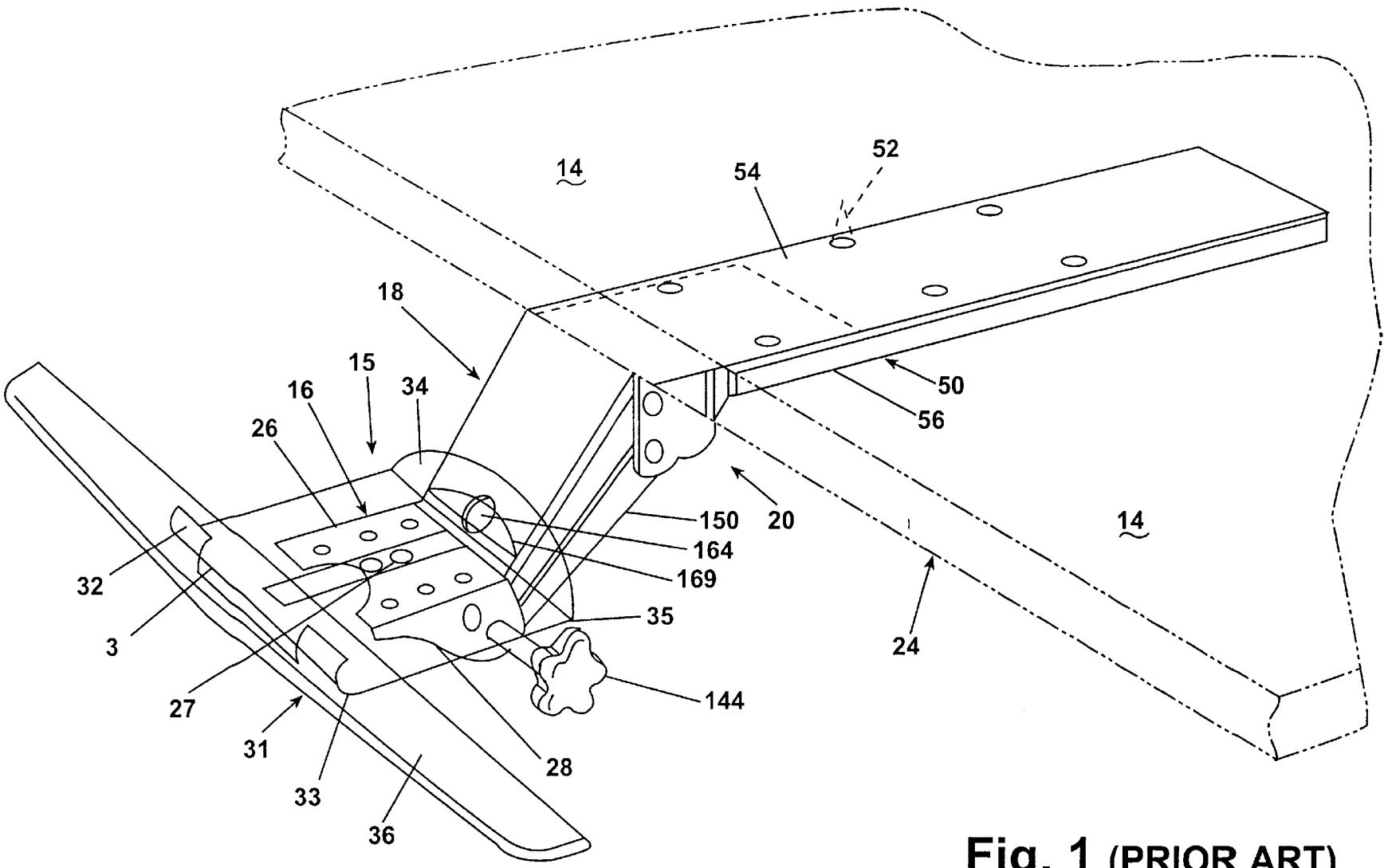
Fig. 1 (PRIOR ART)
FIG. 1 is a perspective view of a prior art keyboard support mechanism described above.
Figure 2:
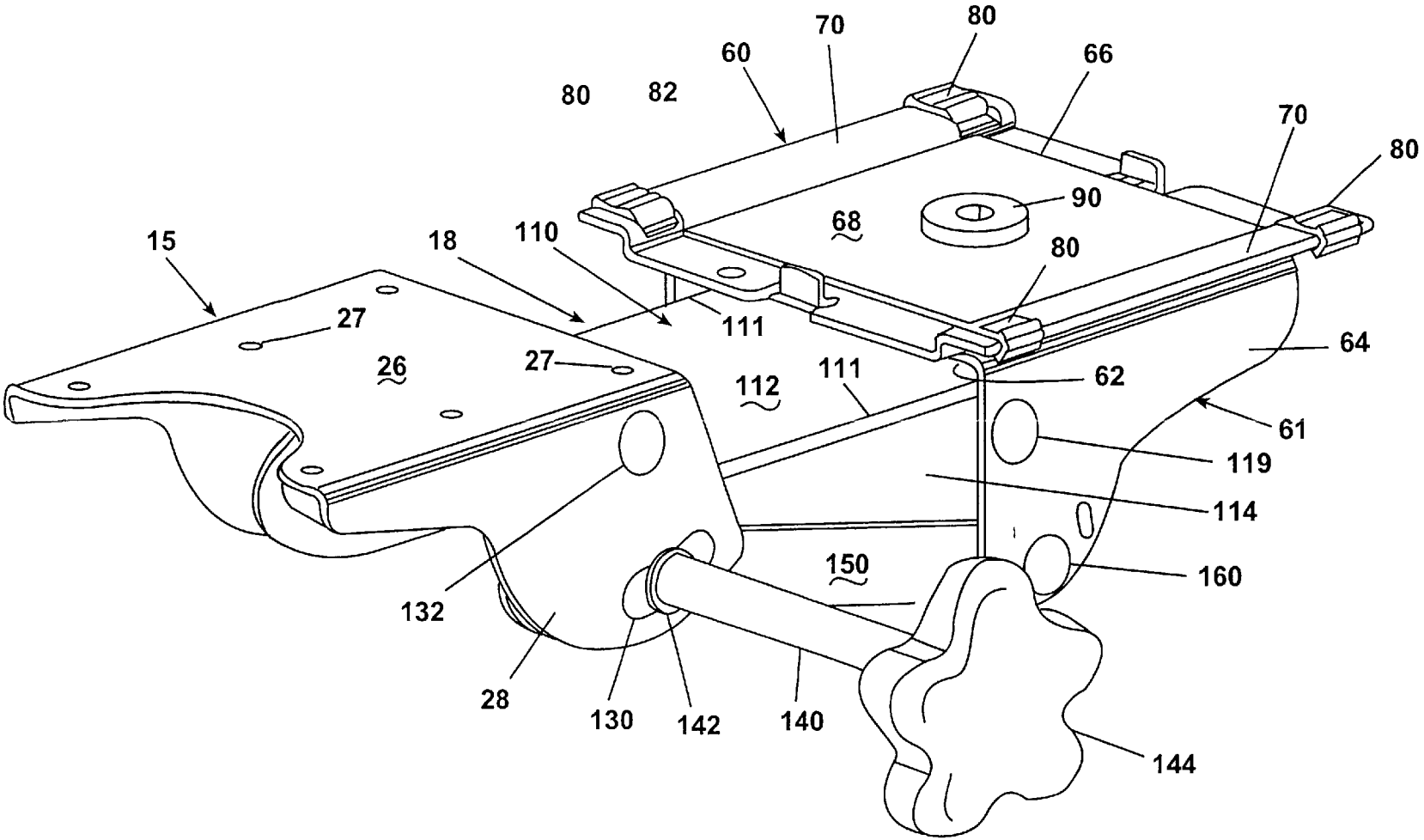
Fig. 2 (PRIOR ART)
FIG. 2 is a perspective view of the keyboard support mechanism shown in FIG. 1.
Figure 3:
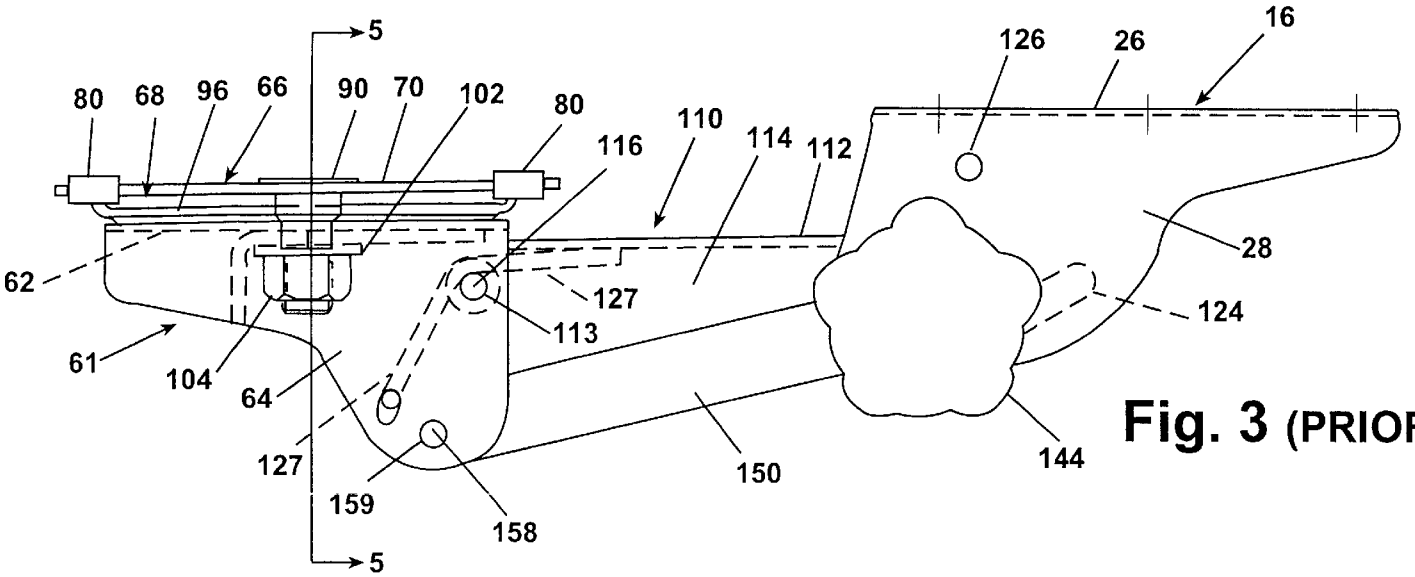
Fig. 3 (PRIOR ART)
FIG. 3 is a side elevational view of the keyboard support mechanism of FIG. 2.
Figure 4:
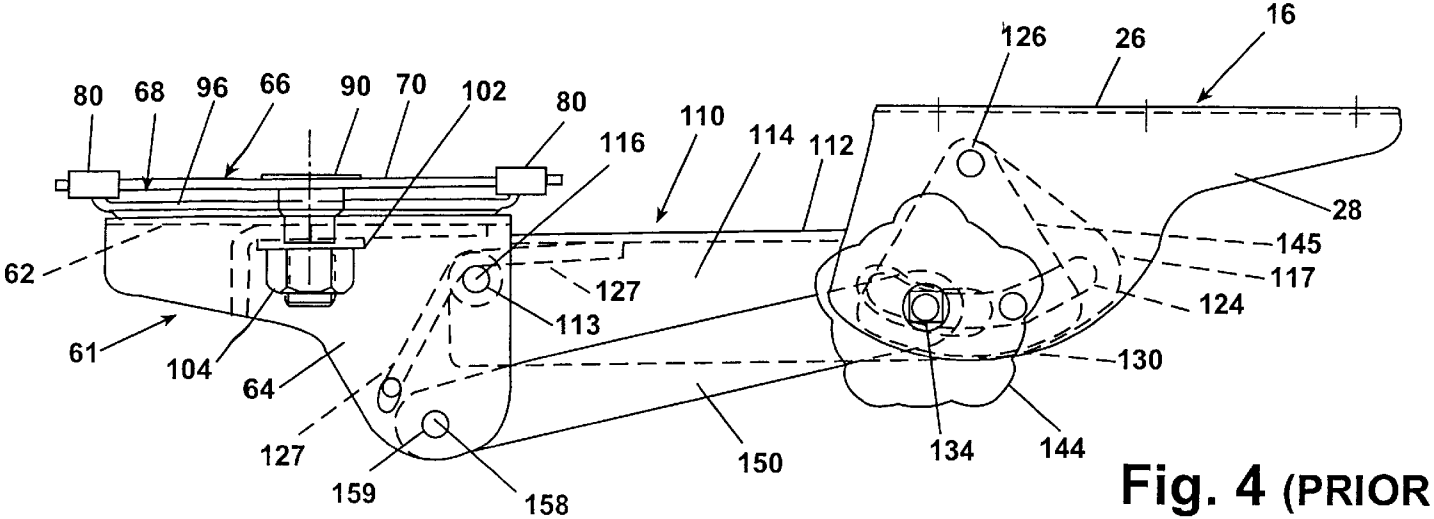
Fig. 4 (PRIOR ART)
FIG. 4 is a side elevational view similar to FIG. 3, but showing the nonvisible components in phantom.
Figure 5:
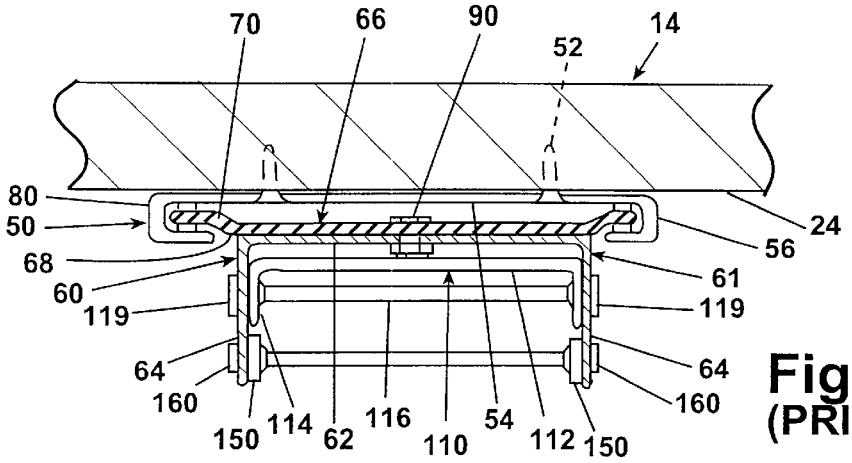
Fig. 5 (PRIOR ART)
FIG. 5 is a sectional view taken along line 5—5 of FIG. 3, but showing the slide apparatus mounted on the underside of a work surface.
Figure 6:
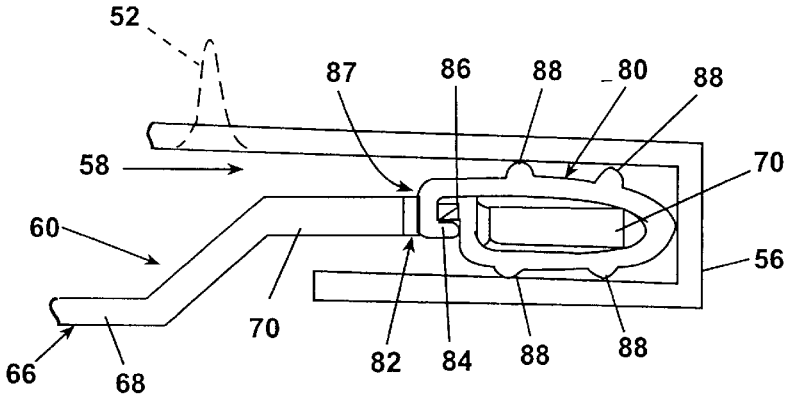
Fig. 6 (PRIOR ART)
FIG. 6 is a front partial sectional view showing the manner in which the slidable carriage is mounted in the track on the underside of a work surface.
Figure 7:
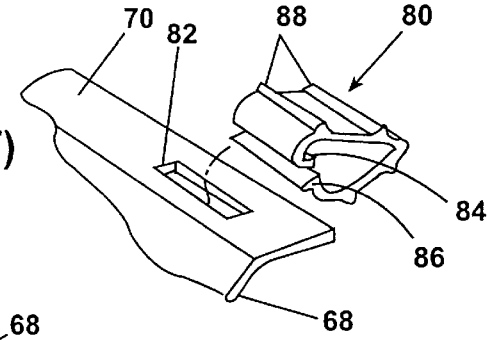
Fig. 7 (PRIOR ART)
FIG. 7 is a perspective view showing the manner in which bearing members are mounted in the flanges of the carriage.
Figure 8:
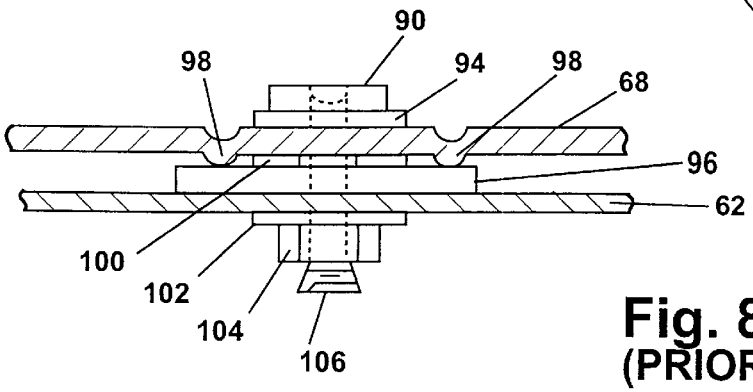
Fig. 8 (PRIOR ART)
FIG. 8 is a partial enlarged sectional view showing the manner in which the work surface mounting bracket is mounted to the slider plate of the moveable carriage.
Figure 9:
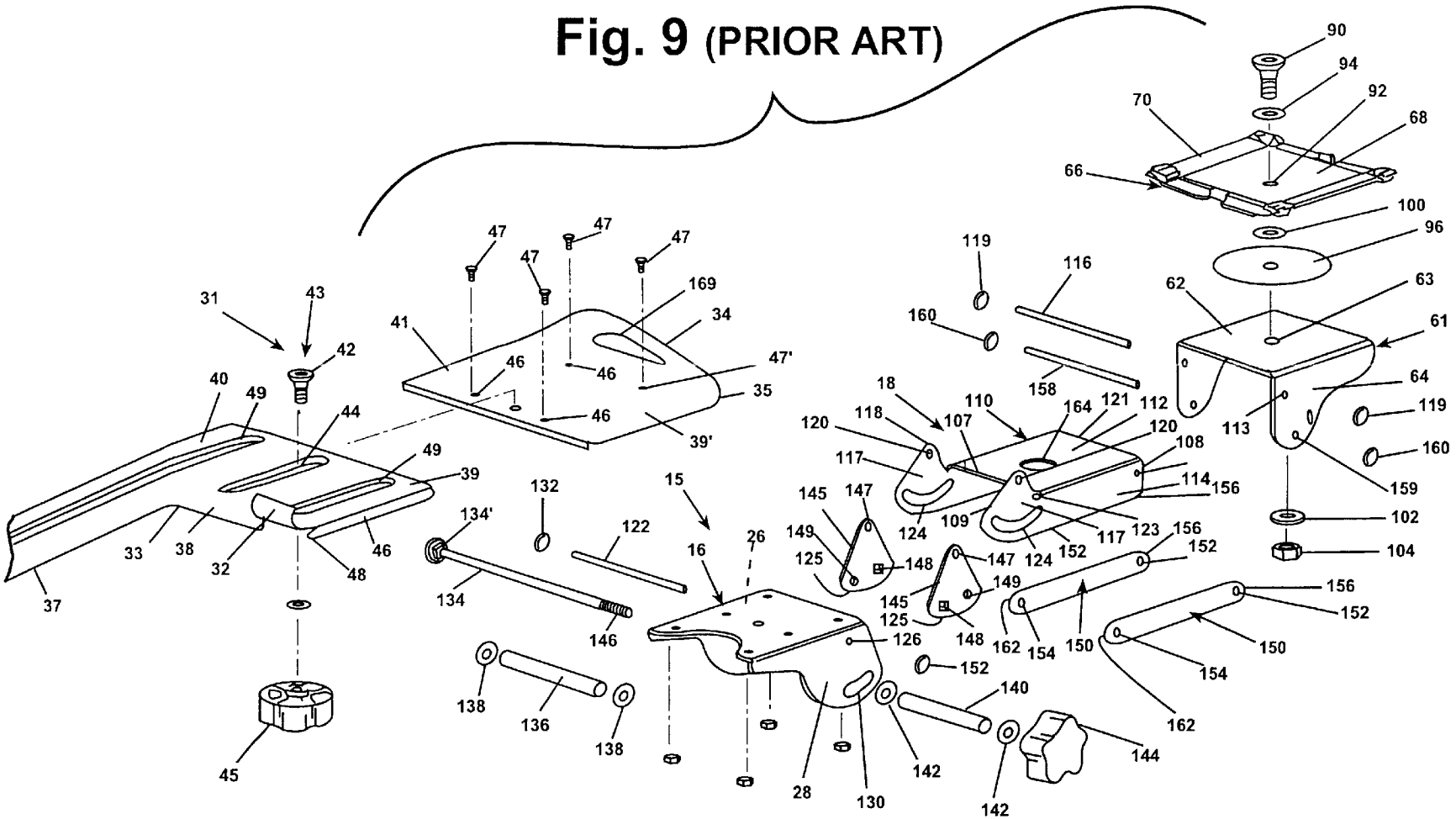
Fig. 9 (PRIOR ART)
FIG. 9 is an exploded view showing the components of the keyboard support mechanism of FIGS. 1–8.
Figure 10:
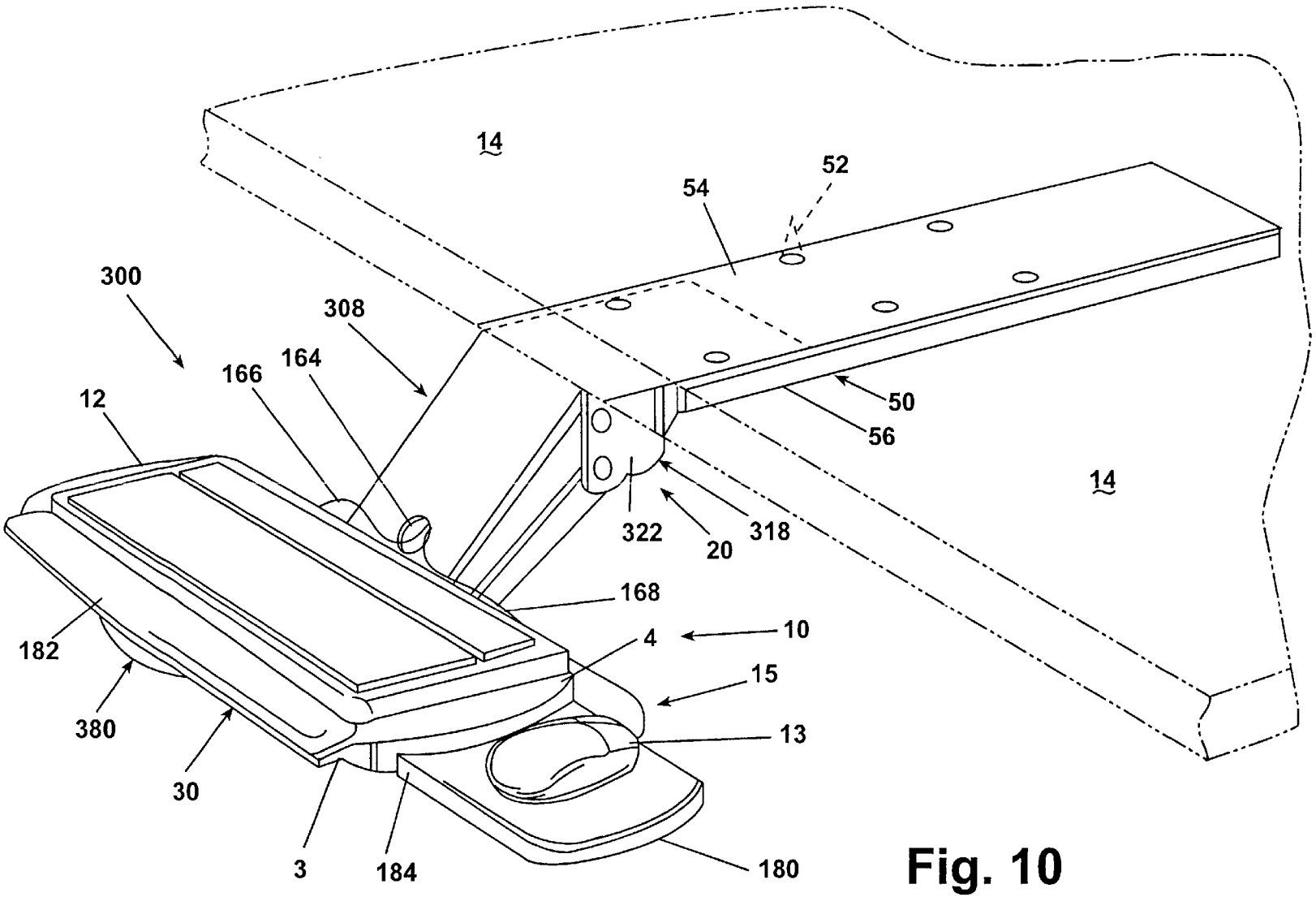
FIG. 10 is a perspective view of a keyboard support tray and mouse support tray with a keyboard support mechanism according to the invention.

Referring, now to the drawings and to FIG. 10, in particular, a keyboard tray 30 includes a supporting surface 4 having a flat top surface for supporting keyboard 12, a front edge 3 and a bottom surface. The front edge 3 supports a wrist rest 182 covered with a flexible padded material. The wrist rest 182 can be integrally formed with the front edge 3 or formed as a separate element. A mouse platform 180, 30 a flat rectangularly shaped plastic member, can be slidably mounted the keyboard platform tray 30 for movement there with through known mounting assemblies. A lever control bar 380 is mounted beneath the keyboard tray 30 for grasping by the user to adjust the angular and/or height of the keyboard tray 30 with respect to the work surface 14 in a manner which will be described hereinafter.

Referring now to FIGS. 11–20 a keyboard support mechanism 300 according to the invention is similar is some respects to some of the parts in the prior art adjustment mechanism described above. Most of the components of this embodiment are identical to those of described in FIGS. 1–9 and, therefore, will not be discussed in detail for the sake of brevity. Like numerals have been used to describe like parts. The principal difference between the present invention and the previously described prior art adjustment mechanism is the use of a lever-operated control bar 380 and a spring actuated angle control mechanism 358 instead of control knob 144 to reposition keyboard tray support bracket 304.

Figure 11:
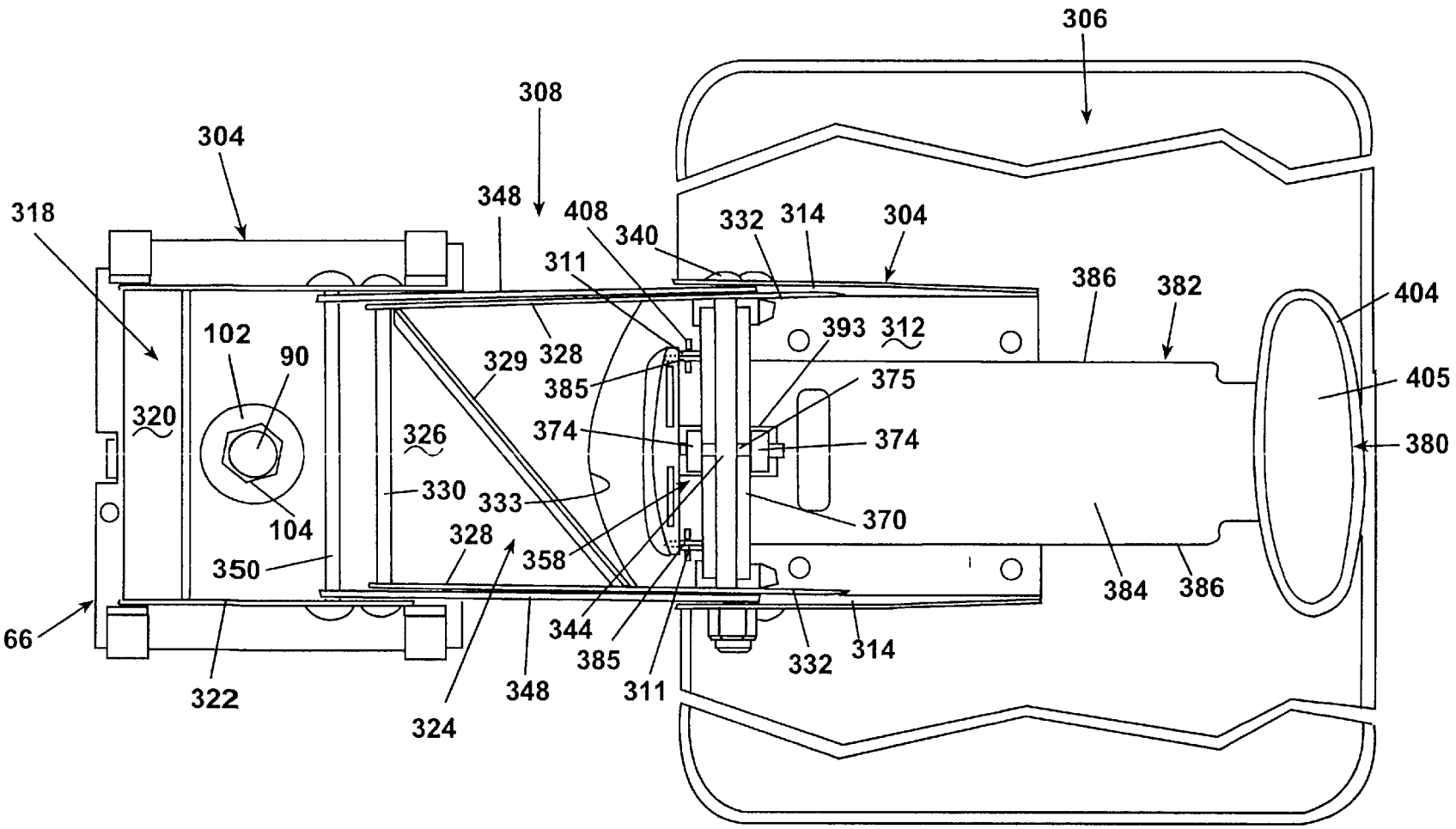
FIG. 11 is a bottom plan view of a keyboard support mechanism formed in accordance with the teaching of the present invention, employing a lever operated control bar for releasing and clamping the keyboard tray support bracket in a desired position.
Figure 12:
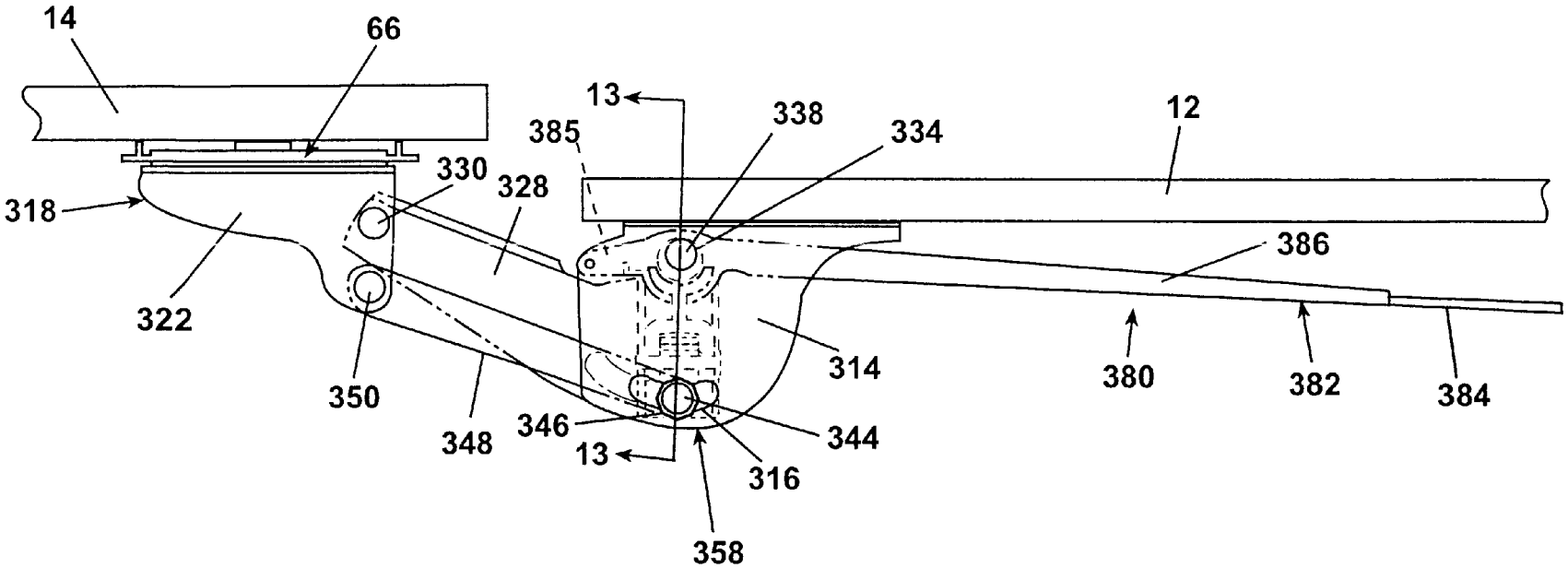
FIG. 12 is a side-elevational view of the keyboard support mechanism shown in FIG. 11.
Figure 15:
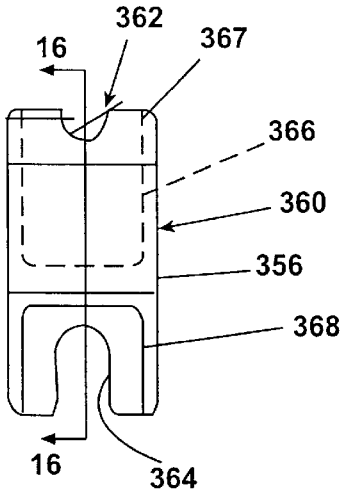
FIG. 15 is a plan view of a clamping plate employed in the present invention.
Figure 16:
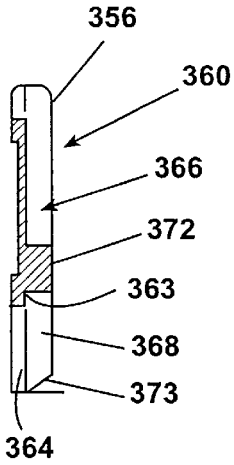
FIG. 16 is a sectional view taken along lines 16—16 of FIG. 15.
Figure 17:
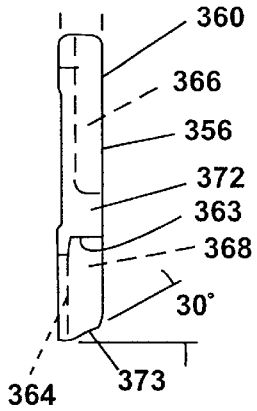
FIG. 17 is an edge view of the clamping plate of FIG. 15.
Figure 18:
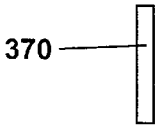
FIG. 18 is a plan view of one leaf of a fiberglass spring employed in the present invention.
Figure 19:
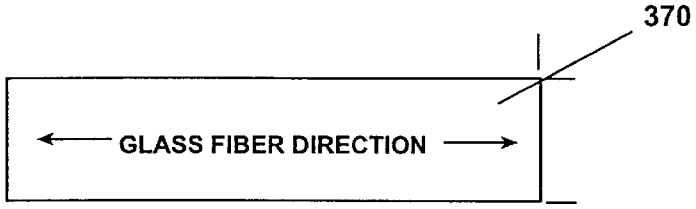
FIG. 19 is an end view of the fiberglass spring of FIG. 18.

As in the previously described prior devices, keyboard support mechanism 300 includes a keyboard tray support bracket 304 interconnected to a work surface mounting mechanism 302 by a connector mechanism 308, as shown in FIGS. 10–12. Work surface mounting mechanism 302 and keyboard tray support bracket 304 have substantially the same construction as described for work surface mounting mechanism 20 and keyboard tray support bracket 16, respectively, of the previously described prior art devices.

Keyboard tray support bracket 304 mounts a keyboard tray 12 and includes a tray bracket 310 having a flat upper plate 312 coupled to the underside of keyboard tray 12 by fasteners such as screws. Additionally, plate 312 includes downwardly extending side flanges 314. Flanges 314 include an upper end having aligned openings 334 formed therein and a lower end defining an arcuate slot 316, with the center of slot 316 being the axis of openings 334. The flat upper plate has flanges 311 formed at a rear portion and extending downwardly. Each of the flanges 311 has an aligned opening.

Work surface mounting mechanism 302, as shown in FIG. 11, includes a work surface mounting bracket 318 having an upper plate 320 and side flanges 322, all substantially the same as in work surface mounting bracket 61 of the previously described prior art devices. Flanges 322, like flanges 64, include aligned openings 113 located at an upper forward end and aligned openings 159 positioned below openings 113 at the forward end.

Connector mechanism 308 includes support arm 324 having an upper plate 326 and side flanges 328. Flanges 328 extend downwardly from the outer side edges of upper plate 326 and define aligned openings 115 at a rear edge thereof. At a front edge, side flanges 328 define a U-shaped indentation 333. A cross brace 329 extends diagonally across the underside of the upper plane 326 between the side flanges 328.

Additionally, a pair of mounting flanges 332 extends forwardly from the front edge of flanges 328 in the same manner as flanges 117 of the previously described prior art devices. Flanges 332 include aligned openings 334' at an upper portion thereof and arcuate slots 336 at a lower portion thereof, such that the center of the arc of each slot 336 defines the axis of the respective openings 334'.

To form a subassembly comprising connector mechanism 308 and work surface mounting support 302, openings 115 in flanges 328 are aligned with openings 113 of flanges 322. A pivot pin 330 is inserted though aligned openings 115 and 113.

To form a subassembly comprising connector mechanism 308 and keyboard tray support bracket 12, flanges 332 and 314 are coupled together. This union is formed by assembling flanges 332 and 314 such that arcuate slots 336 of flanges 322 overlap slots 316 formed in side flanges 314 of tray bracket 310. A pivot pin 338 extends between aligned openings 334, 334' of flanges 314, 322, respectively. This arrangement joins the top edges of flanges 332 and 314.

The bottom edges of flanges 332 and 314 are coupled together by a bolt 344, which, when tightened, secures connector 308 and keyboard support 304 together. Bolt 344 is positioned parallel to pivot pin 338 and extends through aligned arcuate openings 316 and 336 in flanges 314 and 332, respectively. Bolt 344 includes a head 340 at one end and is fitted with a threaded nut 346 at the other end.

To prevent flanges 332 and 314 from wearing against one another, a friction reducing fiber gasket 352 can be placed over the inner surface of each flange 332. Gasket 352 is substantially the same as fiber gasket 145 of the previously described prior art adjustment mechanism, and includes spaced openings therein that align with openings 316 and 334 of flange 314 upon installation. When the assembly is completed, openings 334 and the respective gasket opening receive pivot pin 338, and slots 316 and the respective gasket opening receive bolt 344. The fiber gasket 352 can be eliminated if desirable.

The opposite side of each gasket 352 abuts a locking arm 348 such that gasket 352 is sandwiched between flanges 314 and locking arms 348 at the inwardly facing surfaces of tray bracket 310. Locking arms 348 are substantially the same as locking arms 150 of the previously described prior art devices, and are pivotally coupled to work surface mounting bracket 318 by means of a pivot pin 350 at one end of locking arm 348. The other end of each locking arm 348 includes openings therein that align with slots 316, 336 of flanges 314, 332, respectively, and through which bolt 344 is received.

The foregoing discussion describes the connection between work surface mounting support 302, connector mechanism 308 and keyboard tray support bracket 304 and the manner of assembling the described components. An angle control mechanism 358 for adjusting the height and inclination of keyboard tray support bracket 12 with respect to supporting arm 324 of connector mechanism 308 will now be described. Angle control mechanism 358 includes a pair of clamping plates 360, a pair of leaf springs 370, spring lifter 371 and a lever control bar 380.

As shown in FIGS. 13–14, clamping plates 360 are positioned adjacent side flanges 332 of support arm 324. Clamping plates 360 are preferably formed of 10–20% glass fiber filled nylon, and each comprises essentially a rectangular flat plate 356. Flat plate 356 forms a groove 362 at an upper end 367 that receives a bottom portion of pivot pin 338 and a groove 364 at a lower end that receives the upper portion of bolt 344. Flat plate 356 also defines recesses 366 in the inner surfaces of the upper portion of clamping plates 360 for receiving the ends of leaf spring 370. Below recesses 366, flat plate 356 includes recesses 368 formed in the inner surfaces of the lower portion of clamping plates 360. An outwardly extending projection 372 is located on flat plate 356 between recesses 366 and 368 and defines a retaining shoulder 363 with recess 368. Additionally, clamping plates 360 include a lower edge 369 having an inclined surface 373 that forms a thirty-degree angle relative to lower edge 369.

The leaf spring 370 is a flat resilient plate, and is positioned in compression between clamping plates 360 and seated in shoulder 363 such that the ends of spring 370 apply an outward clamping force to each plate 360. It will be appreciated that other types of clamps can be used to provide the clamping function of leaf springs 370. Preferably two leafs springs are used for the clamping function although it is within the scope of the invention to use a single leaf spring or more than two leaf springs. The number of leaf springs will depend on the clamping force desired and the thickness of the leaf springs. In a preferred embodiment, each of the two leaf springs 370 has a thickness of approximately 0.067 inches, a width of approximately 0.73 inches and a length of 3.4 inches. The leaf springs 370 is made of a fiber filled synthetic resin. In a preferred embodiment, the leaf spring 370 can be made of a fiberglass filled polyester resin and formed by a pultrusion process, for example, described in U.S. Pat. Nos. 4,983,453, 5,585,155, 4,154,634 or 5,324, 377. Pultruded products are available from POLYGON Company of Walkerton, Ind.

Figure 20:
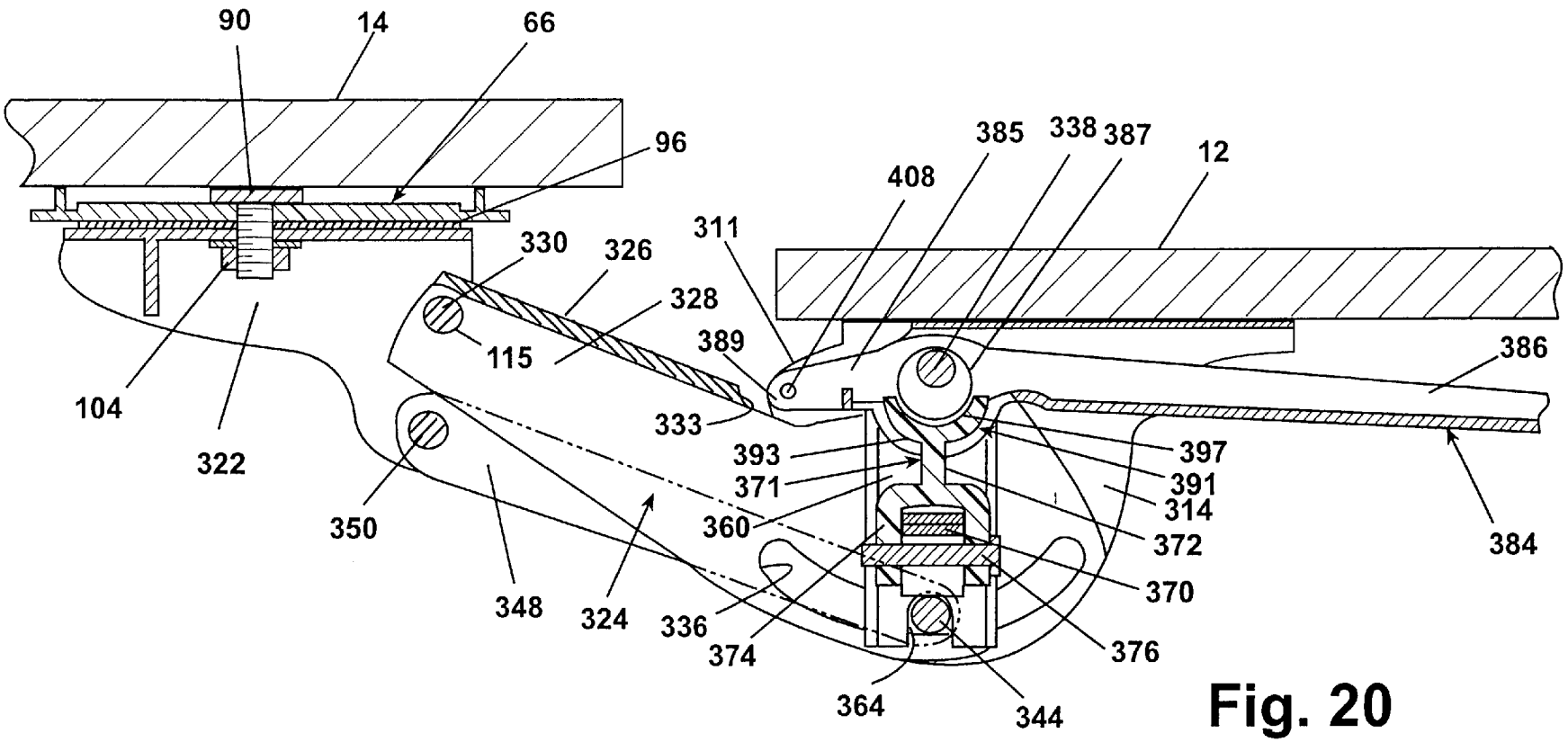
FIG. 20 is a sectional view taken along lines 20—20 of FIG. 13.

As shown more clearly in FIGS. 13, 14 and 20, spring lifter 371, as the name implies, imparts a lifting force on springs 370. Spring lifter 371 includes a central web 372 which is connected at an upper end to an arcuate retainer 397 and at a lower end to a yoke 374. The ends of the yoke 374 have aligned openings which receive a pin 375 which extends below the springs 370.

To install angle control mechanism 358, the pin 375 is inserted through the aligned openings in the yoke 374 and beneath the spring 370. Each end of spring 370 abuts in recesses 368 of the clamping plates 360 and abuts shoulder 363 of clamping plates 360. The shoulders 363 hold the ends of spring 370 in abutting relationship with clamping plates 360 between projection 372 and bolt 344 positioned.

As shown in FIGS. 13–14, the distance between clamping plates 360 when installed between side flanges 328 of bracket 318 is less than the length of spring 370, thus requiring spring 370 to be resiliently bowed when installed. Since spring 370 is resilient and is deflected when installed, spring 370 exerts an outward pressure against inclined surface 373 of clamping plates 360. Clamping plates 360 in turn press side flanges 328 of support arm 324 against locking arms 348 and against fiber gasket 352 and, thus, against side flanges 314 of tray bracket 310. This arrangement, together with the clamping pressure supplied by bolt 344, resiliently clamps the various components together and holds keyboard tray 12 at the desired height and inclination. The characteristics and dimensions of spring 370 are selected so that the components are held in position securely when the ends of spring 370 press against flanges 314 and 328.

As shown in FIG. 13, when handle base 384 is in a lower position relative to pivot pin 338, spring 370 exerts pressure against clamping plates 360 to clamp the keyboard tray in an adjusted position. When, however, handle base 384 is lifted upwardly (as shown in FIG. 14) so that the arcuate retainer 397 contacts pivot pin 338, the pin 375 of the spring lifter 371 moves upwardly to raise the central portion of springs 370 to increase the bow in the springs 370. This action pulls the ends of spring 370 and clamping plates 360 inwardly, relieving the clamping pressure of clamping plates 360 against the mounting flanges 332, locking arms 348 and side flanges 314. When the pressure is relieved, keyboard tray 12 is released for adjustment in height and inclination with respect to the work surface 14.

Spring lifter 371 is actuated by means of a lever control bar 380 positioned under keyboard tray 12. Lever control bar 380 includes an outwardly projecting handle 382 that extends substantially co-extensively with the outer edge of keyboard tray 12, such that the end of handle 382 extends just short of the outer edge of keyboard tray 12. Lever control bar 380 also includes a handle base 384 having upstanding side flanges 386 that have enlarged openings 387 for receiving pivot pin 338. The diameter of the openings 387 are somewhat larger than the outer diameter of the pivot pin 338 so that the pivot pin 338 can articulate within the openings 387 when the lever control bar 380 is lifted. The side flanges 386 project rearwardly of the openings 387 at 385 and define openings 389 that are aligned with the openings in the depending mounting flanges 311 of the plate 312. Fasteners such as rivets or pin connectors 408 are received in the openings 389 in the rearward projections 385 and in the depending mounting flanges 311 of the plate 312 for pivotally mounting the lever control bar 384 to the depending mounting flanges 311 of the plate 312. Thus, the lower control bar 380 is pivotally mounted on the pins 408 and for pivotal movement with respect to tray bracket 310.

Handle base 384 also forms an arcuate transverse depression 391 at a rear portion and includes a rectangular opening 393 at a rear end for receiving the central web of spring lifter 371. The arcuate retainer 397 is cradled in the arcuate transverse depression 391 and passes through the rectangular opening 393 when rotated 90° about a vertical axis from the position shown in FIGS. 13, 14 and 20. The arcuate retainer 397 pivots within the transverse depression 391 as the angular relationship between the handle base 384 and the connector mechanism 308 changes. As the keyboard support tray 12 rotates about the pivot pin 338 with respect to the connector mechanism 308, the handle base 384 moves with the keyboard support tray 12. Thus, the angular relationship between the handle base 384 and the spring lifter 371 changes. However, the relationship between the spring lifter 371 and the leaf spring 370 remains constant. Because of the arcuate shape of the transverse depression 391, the handle base 384 can rotate about the pivot pin 338 as well. Thus, the mechanical relationship between the handle base 384 and the spring lifter 371 remains constant regardless of the angular relationship between the keyboard support tray 12 and the connector mechanism 308. This functional relationship is an important feature of the invention because it achieves the desired functional relationship with simple, stamped mechanical parts and does need to require expensive cable or other indirect connections which lose efficiency through multiple links.

The lever control bar 380 terminates at an outer end in an enlarged loop 404. An oval handle pad 405 having a grooved central portion covers loop 404. Handle pad 405 provides a comfortable handle grip for actuating lever control bar 380. Handle pad 405 can be adapted to receive or to be imprinted with various indicia.

To adjust tray support bracket 15, a user can grasp the handle 382 and the outer end of the keyboard tray 12 in one hand and squeeze the handle 382 toward the keyboard tray 12, thereby releasing the clamping pressure on the adjustment mechanism. The keyboard 12 can then be adjusted with the same hand while holding the handle 382 against the keyboard tray 12. When the adjustment is complete, the user simply releases the grip on the handle 382 and keyboard tray 12 to set the keyboard tray in adjusted position.

The upward pivotal movement of handle 382 lifts spring lifter 371 upwardly within the confines of movement permitted by the arcuate lifter surface 397 and the pivot rod 338 as illustrated in FIG. 14. This action bends spring 370 to a more arcuate shape, which shortens the length of spring 370, thus, relieving the pressure on clamping plates 360. When lever control bar 380 is lifted upwardly, the release of pressure on spring 370 is sufficient to freely adjust the keyboard tray 12 with respect the work surface 14. When handle 382 is released, spring 370 is flattens out to a certain degree. This action causes enough pressure to be exerted on the angle control mechanism 358 to resiliently clamp the components in place no matter what the tilt or height adjustment of keyboard support 15.

The keyboard support mechanism 300 provide a substantial advantage over a hand-operated clamp illustrated in FIGS. 1–9, which must be screwed and unscrewed in order to adjust the components with one hand while holding the keyboard tray with the other tray. The keyboard support mechanism 300 as described herein can be manipulated using one hand to lift handle 382. The components automatically clamp and lock the keyboard in place when handle 382 is released. The use of leaf spring 370 and spring lifter 371 for purposes of releasing and clamping the components together provides a simple, yet cost effective mechanism for accomplishing this purpose with a minimum number of parts and expense.

This system also provides an advantage over linkage systems in that it uses fewer parts and permits direct actuation of keyboard support mechanism 300 without the use of cabling or linkage connections such as parallelogram linkage systems.

There are a variety of configurations that may be employed to fabricate the adjustable keyboard support mechanism of the present invention. Thus, the disclosed embodiment is given to illustrate the invention. Reasonable variation and modification are possible within the scope of the forgoing disclosure and drawings without departing from the scope of the invention which is defined in the appended claims.

We claim:

1. An adjustable keyboard support assembly, comprising:

a keyboard tray support bracket;

a work surface mounting bracket adapted to be coupled to a work surface;

a connector mechanism having one end coupled to the work surface mounting bracket and an opposite end coupled to the keyboard tray support bracket, the connector mechanism comprising a support arm mounted at one end to the work surface mounting bracket and a coupling mounting another end of the support arm to the keyboard tray support bracket for rotatable movement of the keyboard tray support bracket about a horizontal axis with respect to the support arm;

an angle control mechanism between the keyboard tray support bracket and the support arm for locking the keyboard tray support bracket at a desired angular inclination with respect to the support arm, the angle control mechanism including a spring exerting a clamping pressure on the support arm and the keyboard tray support bracket and a spring lifter for repositioning the spring so as to relieve the pressure applied to the support arm and the keyboard tray support bracket; and a lever control bar coupled to the keyboard tray support bracket and spring lifter for selective repositioning of the spring lifter for selective adjustment of the keyboard tray support bracket with respect to the support arm.

2. The adjustable keyboard support assembly according to claim 1 wherein the coupling mounting another end of the support arm to the keyboard tray support bracket comprises a pivotal mounting.

3. The adjustable keyboard support assembly according to claim 1, wherein the angle control mechanism further includes a pair of spaced apart clamping plates, wherein the spring is placed between the clamping plates.

4. The adjustable keyboard support assembly according to claim 3, wherein the spring comprises at least one leaf spring.

5. The adjustable keyboard support assembly according to claim 4, wherein the at least one leaf spring comprises a fiber filled synthetic resin.

6. The adjustable keyboard support assembly according to claim 5, wherein the fiber filled synthetic resin is a fiberglass filled polyester resin.

7. The adjustable keyboard support assembly according to claim 6, wherein the at least one leaf spring is pultruded.

8. The adjustable keyboard support assembly according to claim 4, wherein the at least one leaf spring comprises two resilient, elongated plates.

9. The adjustable keyboard support assembly according to claim 3, wherein each clamping plate defines a retaining recess for receiving and retaining the ends of the at least one spring and the ends of the at least one spring are seated in the recess.

10. The adjustable keyboard support mechanism according to claim 3, wherein the clamping plates are fabricated of a glass fiber filled nylon material.

11. The adjustable keyboard support assembly according to claim 3, wherein the support arm is positioned between the clamping plate and the keyboard tray support bracket in clamped relationship thereto when the spring exerts clamping pressure against the clamping plate.

12. The adjustable keyboard support assembly according to claim 3, wherein the lever control bar is pivotally mounted to the keyboard tray support bracket.

13. The adjustable keyboard support assembly according to claim 12 further comprising a keyboard tray mounted to the keyboard tray support bracket, wherein the lever control bar is substantially co-extensive with a front edge of the keyboard tray and adjacent thereto for release of the clamping mechanism and adjustment of the keyboard tray with respect to a work surface with one hand by the user.

14. The adjustable keyboard support assembly according to claim 1, wherein the spring is at least one leaf spring.

15. The adjustable keyboard support assembly according to claim 14, wherein the at least one leaf spring comprises a fiber filled synthetic resin.

16. The adjustable keyboard support assembly according to claim 15, wherein the fiber filled synthetic resin is a fiberglass filled polyester resin.

17. The adjustable keyboard support assembly according to claim 16, wherein the at least one leaf spring is pultruded.

18. The adjustable keyboard support assembly according to claim 14, wherein the at least one leaf spring comprises two resilient, elongated plates.

19. The adjustable keyboard support assembly according to claim 14, wherein the lever control bar is pivotally mounted to the keyboard tray support bracket.

20. The adjustable keyboard support assembly according to claim 19 further comprising a keyboard tray mounted to the keyboard tray support bracket, wherein the lever control bar is substantially co-extensive with a front edge of the keyboard tray and adjacent thereto for release of the clamping mechanism and adjustment of the keyboard tray with respect to a work surface with one hand by the user.

21. The adjustable keyboard support assembly according to claim 1 the connector mechanism is pivotally mounted to the work surface mounting bracket and to the keyboard tray support bracket so as to permit height adjustment of the keyboard tray support bracket with respect to the work surface mounting bracket.

22. The adjustable keyboard support assembly according to claim 1 and further comprising a pivot mount between the spring lifter and the lever control bar.

23. An adjustable keyboard support assembly, comprising:

a keyboard tray support bracket;

a work surface mounting bracket adapted to be coupled to a work surface;

a connector mechanism having one end coupled to the work surface mounting bracket and an opposite end coupled to the keyboard tray support bracket, the connector mechanism comprising a support arm pivotally mounted at one end to the work surface mounting bracket and a coupling mounting another end of the support arm to the keyboard tray support bracket for vertical movement of the keyboard tray support bracket with respect to the work surface mounting bracket;

a height control mechanism between the keyboard tray support bracket and the support arm for locking the keyboard tray support bracket at a desired height with respect to the work surface mounting bracket, the height control mechanism including a spring exerting a clamping pressure on the support arm and the keyboard tray support bracket and a spring lifter for repositioning the spring so as to relieve the pressure applied to the support arm and the keyboard tray support bracket; and a lever control bar coupled to the keyboard tray support bracket and spring lifter for selective repositioning of the spring lifter for selective height adjustment of the keyboard tray support bracket with respect to the work surface mounting bracket.

24. The adjustable keyboard support assembly according to claim 23, wherein the angle control mechanism further includes a pair of spaced apart clamping plates, wherein the spring is placed between the clamping plates.

25. The adjustable keyboard support assembly according to claim 24, wherein the spring comprises at least one leaf spring.

26. The adjustable keyboard support assembly according to claim 25, wherein the at least one leaf spring comprises a fiber filled synthetic resin.

27. The adjustable keyboard support assembly according to claim 26, wherein the fiber filled synthetic resin is a fiberglass filled polyester resin.

28. The adjustable keyboard support assembly according to claim 27, wherein the at least one leaf spring is pultruded.

29. The adjustable keyboard support assembly according to claim 25, wherein the at least one leaf spring comprises two resilient, elongated plates.

30. The adjustable keyboard support assembly according to claim 24, wherein each clamping plate defines a retaining recess for receiving and retaining the ends of the at least one spring and the ends of the at least one spring are seated in the recess.

31. The adjustable keyboard support mechanism according to claim 24, wherein the clamping plates are fabricated of a glass fiber filled nylon material.

32. The adjustable keyboard support assembly according to claim 24, wherein the support arm is positioned between the clamping plate and the keyboard tray support bracket in clamped relationship thereto when the spring exerts clamping pressure against the clamping plate.

33. The adjustable keyboard support assembly according to claim 24 wherein the support arm comprises a pair of spaced depending connecting flanges having aligned openings and a pair of aligned arcuate slots, the connecting flanges are adjacent to and in abutting contact with the spaced apart clamping plate; the keyboard tray support bracket has a pair of depending flanges with two sets of aligned openings and which are adjacent to the connecting flanges; and a pivot pin extends through the aligned openings in the connecting flanges and one set of the aligned openings in the keyboard tray support bracket depending flanges to pivotally mount the other end of the support arm to the keyboard tray support bracket; and the connector mechanism further comprises a pair of locking arms pivotally mounted to the work surface mounting bracket at one end and having a pair of aligned openings at another end in register with the connecting flanges aligned arcuate slots and with the other set of the aligned openings in the keyboard tray support bracket depending flanges; and a pin extending through the aligned openings in locking arms at the other end, the other set of aligned openings in the keyboard tray support bracket depending flanges and through the pair of aligned arcuate slots in the support arm, the pin having a head at each end to clamp the keyboard tray support bracket, the locking arms, the support arm and the clamping plate together against the force of the spring.

34. The adjustable keyboard support assembly according to claim 23, wherein the lever control bar is pivotally mounted to the keyboard tray support bracket.

35. The adjustable keyboard support assembly according to claim 34 and further comprising a keyboard tray mounted to the keyboard tray support bracket, wherein the lever control bar is substantially co-extensive with a front edge of the keyboard tray and adjacent thereto for release of the clamping mechanism and adjustment of the keyboard tray with respect to a work surface with one hand by the user.

36. The adjustable keyboard support assembly according to claim 23 and further comprising a keyboard tray mounted to the keyboard tray support bracket, wherein the lever control bar is substantially co-extensive with a front edge of the keyboard tray and adjacent thereto for release of the clamping mechanism and adjustment of the keyboard tray with respect to a work surface with one hand by the user.

37. The adjustable keyboard support assembly according to claim 23, wherein the spring comprises at least one leaf spring.

38. The adjustable keyboard support assembly according to claim 37, wherein the at least one leaf spring comprises a fiber filled synthetic resin.

39. The adjustable keyboard support assembly according to claim 38, wherein the fiber filled synthetic resin is a fiberglass filled polyester resin.

40. The adjustable keyboard support assembly according to claim 39, wherein the at least one leaf spring is pultruded.

41. The adjustable keyboard support according to claim 23 and further comprising a pivot mount between the spring lifter and the lever control bar.

42. An adjustable keyboard support assembly, comprising:

a keyboard tray support bracket;

a work surface mounting bracket adapted to be coupled to a work surface;

a keyboard tray mounted to the keyboard tray support bracket and having a front edge distal from the work surface mounting bracket;

a connector mechanism having one end coupled to the work surface mounting bracket and an opposite end coupled to the keyboard tray support bracket for rotation about a horizontal axis and height articulation of the keyboard tray support bracket with respect to the work surface mounting bracket;

a locking mechanism associated with the connector mechanism for selectively locking the keyboard tray support bracket at a desired articulated position with respect to the work surface mounting bracket;

a release mechanism coupled to the locking mechanism and including a lever control bar coupled to the locking mechanism for selectively releasing the locking mechanism for selective adjustment of the height and/or angular orientation of the keyboard tray support bracket with respect to the work surface mounting bracket; and the lever control bar has an outer end which is substantially co-extensive with the front edge of the keyboard tray and adjacent thereto for release of the locking mechanism and adjustment of the keyboard tray with respect to a work surface with one hand by the user.

43. The adjustable keyboard support assembly according to claim 42, wherein the lever control bar is pivotally mounted to the keyboard tray support bracket.

44. The adjustable keyboard support assembly according to claim 42 wherein the locking mechanism includes at least one leaf spring.

45. The adjustable keyboard support assembly according to claim 44, wherein the at least one leaf spring comprises a fiber filled synthetic resin.

46. The adjustable keyboard support assembly according to claim 45, wherein the fiber filled synthetic resin is a fiberglass filled polyester resin.

47. The adjustable keyboard support assembly according to claim 46, wherein the at least one leaf spring is pultruded.

48. The adjustable keyboard support assembly according to claim 47, wherein the at least one leaf spring comprises two resilient, elongated plates.

49. The adjustable keyboard support assembly according to claim 43, wherein the at least one leaf spring comprises two resilient, elongated plates.

50. In an adjustable keyboard assembly, comprising:

a keyboard tray adapted to support a keyboard and having an upper surface and a lower surface defined by at least one edge;

a keyboard tray support bracket mounting the keyboard tray;

a work surface mounting bracket adapted to be coupled to a work surface;

a connector mechanism having one end coupled to the work surface mounting bracket and an opposite end coupled to the keyboard tray support bracket for relative movement of the keyboard support bracket with respect to the work surface mounting bracket;

a locking control mechanism mounted to the connector mechanism for releasably locking the keyboard tray support bracket in a locked condition at a desired angular inclination and height with respect to the work surface mounting bracket;

the locking control mechanism further includes a release member for selectively releasing the locking of the keyboard tray support bracket with respect to the work surface mounting bracket;

the improvement which comprises:

the locking control mechanism includes a spring to bias the locking of keyboard tray support bracket with respect to the work surface mounting bracket; and the release member includes a lever pivotally mounted with respect to the keyboard tray support bracket and having a first portion operably connected to the spring;

the lever is movable between a locking position in which the spring bias locks the keyboard tray support bracket with respect to the work surface mounting bracket and an unlocking position in which the spring bias is relieved so that the keyboard tray support bracket is relatively movable with respect to the work surface mounting bracket; and the lever extends beneath the keyboard tray lower surface to a second portion distal from the first portion and that is positioned adjacent the at least one edge of the keyboard tray, and wherein the lever second portion moves toward the keyboard tray at least one edge when the lever moves between the locking position and the unlocking position;

whereby a user can grasp the keyboard tray at the at least one edge and the lever second portion with one hand, unlock the locking control mechanism by squeezing the lever second end and the keyboard tray toward each other and, at the same time with the same hand, can adjust the relative position of the keyboard tray with respect to the work surface mounting bracket.

51. An adjustable keyboard assembly according to claim 50 wherein the keyboard tray support bracket is coupled to the work surface mounting bracket for relative tilting about a horizontal axis with respect to the work surface mounting bracket.

52. An adjustable keyboard assembly according to claim 51 wherein the keyboard tray support bracket is further coupled to the work surface mounting bracket for relative vertical movement with respect to the work surface mounting bracket.

53. An adjustable keyboard assembly according to claim 50 wherein the keyboard tray support bracket is coupled to the work surface mounting bracket for relative vertical movement with respect to the work surface mounting bracket.

54. An adjustable keyboard assembly according to claim 50 wherein the spring is a leaf spring having a central portion between opposite ends and the leaf spring is resiliently bowed in compression in the connector mechanism to exert outward locking forces at opposite ends of the spring when the keyboard tray support bracket is in the locked condition.

55. An adjustable keyboard assembly according to claim 54 wherein the lever first portion is connected to the central portion of the leaf spring to increase the bow of the leaf spring to release the outward locking forces at the outer ends of the spring when the lever moves between the locking position and the unlocking position.

56. An adjustable keyboard assembly according to claim 50 wherein the at least one edge of the keyboard tray is a front edge thereof.

57. An adjustable keyboard support assembly, comprising:

a keyboard tray support bracket;

a work surface mounting bracket adapted to be coupled to a work surface;

a keyboard tray mounted to the keyboard tray support bracket and having an upper surface and lower surface bounded by at least one edge distal from the work surface mounting bracket;

a connector mechanism having a first end coupled to the work surface mounting bracket and a second end coupled to the keyboard tray support bracket for relative adjustment of the keyboard tray support bracket with respect to the work surface mounting bracket; and a locking mechanism associated with the connector mechanism for selectively locking the keyboard tray support bracket at a desired position with respect to the work surface mounting bracket;

a release mechanism coupled to the keyboard tray support bracket for selectively releasing the locking mechanism for selective adjustment of the keyboard tray with respect to the work surface mounting bracket, the release mechanism including a lever control bar movable between a locking position and an unlocking position;

the lever control bar extends beneath the keyboard tray lower surface from the locking mechanism to the at least one edge, the lever control bar has a gripping portion adjacent the at least one edge and the lever control bar is movable toward the at least one edge as the lever control bar moves between the locking position and the unlocking position, whereby a user can release the locking mechanism by squeezing together with one hand the keyboard tray at the at least one edge and the gripping portion of the lever and, at the same time with the same hand, can adjust the keyboard tray support bracket with respect to the work surface mounting bracket.

58. The adjustable keyboard support assembly of claim 57, wherein the connector mechanism is coupled to the keyboard tray support bracket for adjustment of the keyboard tray support bracket about a horizontal axis with respect to the work surface mounting bracket.

59. The adjustable keyboard support assembly of claim 58, wherein the locking mechanism further comprises a leaf spring exerting opposing clamping forces between the connector mechanism and the keyboard tray support bracket.

60. The adjustable keyboard support assembly of claim 59, wherein the lever control bar is elongate and substantially parallel to an underside of the keyboard tray support bracket.

61. The adjustable keyboard support assembly of claim 57, wherein the locking mechanism further comprises a leaf spring exerting opposing clamping forces between the connector mechanism and the keyboard tray support bracket.

62. The adjustable keyboard support assembly of claim 57, wherein the lever control bar is elongate and substantially parallel to an underside of the keyboard tray support bracket.

63. The adjustable keyboard support assembly of claim 57, wherein the connector mechanism is coupled to the keyboard tray support bracket for vertical adjustment of the keyboard tray support bracket with respect to the work surface mounting bracket.

* * * * *